US011030927B2

(12) United States Patent
Kim et al.

(10) Patent No.: US 11,030,927 B2
(45) Date of Patent: Jun. 8, 2021

(54) METHOD OF PERFORMING A SENSING OPERATION IN AN ORGANIC LIGHT EMITTING DIODE DISPLAY DEVICE, AND ORGANIC LIGHT EMITTING DIODE DISPLAY DEVICE

(71) Applicant: Samsung Display Co., LTD., Yongin-si (KR)

(72) Inventors: Kyungman Kim, Suwon-si (KR); Wook Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 35 days.

(21) Appl. No.: 16/673,664

(22) Filed: Nov. 4, 2019

(65) Prior Publication Data

US 2020/0143723 A1 May 7, 2020

(30) Foreign Application Priority Data

Nov. 6, 2018 (KR) ..... 10-2018-0134986

(51) Int. Cl.
*G09G 3/00* (2006.01)
*G09G 3/3258* (2016.01)

(52) U.S. Cl.
CPC ..... *G09G 3/006* (2013.01); *G09G 3/3258* (2013.01); *G09G 2320/0626* (2013.01); *G09G 2330/12* (2013.01)

(58) Field of Classification Search
CPC .. G09G 3/006; G09G 3/3258; G09G 2330/12; G09G 2320/0626
See application file for complete search history.

(56) References Cited

U.S. PATENT DOCUMENTS

| | | | | |
|---|---|---|---|---|
| 8,994,617 | B2 * | 3/2015 | Chaji | G09G 3/006 345/76 |
| 9,076,387 | B1 * | 7/2015 | Lee | G09G 3/3258 |
| 9,959,807 | B2 | 5/2018 | Lee | |
| 10,762,842 | B2 * | 9/2020 | Kim | G09G 3/3291 |
| 2005/0168491 | A1 * | 8/2005 | Takahara | G09G 3/3241 345/690 |

(Continued)

FOREIGN PATENT DOCUMENTS

| | | |
|---|---|---|
| KR | 10-1056258 | 8/2011 |
| KR | 10-2014-0082498 | 7/2014 |

(Continued)

*Primary Examiner* — Nitin Patel
*Assistant Examiner* — Robert M Stone
(74) *Attorney, Agent, or Firm* — Lewis Roca Rothgerber Christie LLP

(57) ABSTRACT

There is provided a method of performing a sensing operation in an organic light emitting diode (OLED) display device including a plurality of pixels, the method including performing a one-line sensing operation for pixels in one line among the plurality of pixels, determining whether a sensing error occurs based on a result of the one-line sensing operation, when the sensing error is determined not to occur, performing a frame-sensing operation for all of the plurality of pixels, detecting an abnormal sensing-data line from among frame-sensing data generated by the frame-sensing operation, and replacing the abnormal sensing-data line by a data line generated based on at least one sensing-data line that is adjacent to the abnormal sensing-data line in the frame-sensing data.

20 Claims, 11 Drawing Sheets

(56) References Cited

U.S. PATENT DOCUMENTS

2008/0291224 A1* 11/2008 Ishii ..... G09G 3/3233 345/690
2009/0201231 A1* 8/2009 Takahara ..... G09G 3/3233 345/76
2010/0245331 A1* 9/2010 Shirouzu ..... G09G 3/3233 345/212
2013/0036335 A1* 2/2013 Kim ..... G09G 3/006 714/704
2013/0135272 A1* 5/2013 Park ..... G09G 3/3233 345/211
2014/0084792 A1* 3/2014 Oh ..... G09G 3/00 315/120
2014/0176525 A1* 6/2014 Woo ..... G09G 3/3233 345/212
2014/0340436 A1* 11/2014 Kumeta ..... G09G 3/3291 345/691
2015/0061981 A1* 3/2015 Lee ..... G09G 3/3291 345/77
2016/0104422 A1* 4/2016 Kishi ..... G09G 3/006 345/205
2016/0125811 A1* 5/2016 Park ..... G09G 3/3258 345/694
2016/0189615 A1* 6/2016 Kwon ..... G09G 3/3233 345/214
2016/0189630 A1* 6/2016 Chang ..... G09G 3/3233 345/211
2016/0203764 A1* 7/2016 In ..... G09G 3/3291 345/215
2016/0351095 A1* 12/2016 Tani ..... G09G 3/3283
2017/0098407 A1* 4/2017 Jeong ..... G09G 3/2051
2017/0213490 A1* 7/2017 Jeong ..... G09G 3/006
2017/0316738 A1* 11/2017 Sohn ..... G09G 3/3275
2018/0061292 A1* 3/2018 Hong ..... G09G 3/006
2018/0061293 A1* 3/2018 Park ..... G09G 3/006
2018/0322830 A1* 11/2018 Xu ..... H01L 51/0031
2020/0043421 A1* 2/2020 Kang ..... G09G 3/3275

FOREIGN PATENT DOCUMENTS

KR 10-2015-0077597 7/2015
KR 10-2016-0047675 5/2016
KR 10-2017-0055067 5/2017

* cited by examiner

FIG. 4A

410

| | | | | |
|---|---|---|---|---|
| -2 | -1 | 0 | 1 | 2 |
| -2 | -1 | 0 | 1 | 2 |
| -2 | -1 | 0 | 1 | 2 |
| -2 | -1 | 0 | 1 | 2 |
| -2 | -1 | 0 | 1 | 2 |

FIG. 4B

430

| | | | | |
|---|---|---|---|---|
| -2 | -2 | -2 | -2 | -2 |
| -1 | -1 | -1 | -1 | -1 |
| 0 | 0 | 0 | 0 | 0 |
| 1 | 1 | 1 | 1 | 1 |
| 2 | 2 | 2 | 2 | 2 |

METHOD OF PERFORMING A SENSING OPERATION IN AN ORGANIC LIGHT EMITTING DIODE DISPLAY DEVICE, AND ORGANIC LIGHT EMITTING DIODE DISPLAY DEVICE

CROSS-REFERENCE TO RELATED APPLICATION

This application claims priority to, and the benefit of, Korean Patent Application No. 10-2018-0134986, filed on Nov. 6, 2018 in the Korean Intellectual Property Office (KIPO), the content of which is incorporated herein in its entirety by reference.

BACKGROUND

1. Field

Embodiments of the present disclosure relate to methods of performing sensing operations in organic light emitting diode display devices, and the display devices themselves.

2. Description of the Related Art

Even if a plurality of pixels included in a display device, such as an organic light emitting diode (OLED) display device, are manufactured by the same process, driving transistors of the plurality of pixels may have different driving characteristics due to a process variation, or the like. Thus the plurality of pixels may emit light with different luminance. Further, as the OLED display device operates over time, the plurality of pixels may be degraded, and the driving characteristics of the driving transistors may be degraded. To compensate for the initial non-uniformity of luminance and for the degradation, the OLED display device may perform a sensing operation that senses the driving characteristics (e.g., threshold voltages) of the driving transistors of the plurality of pixels. The OLED display device may display an image with uniform luminance by adjusting image data based on sensing data generated by the sensing operation.

However, because of a defect of a sensing line, a defect of a sensing circuit, a defect of a data driver, etc., a sensing error may occur, or a particular sensing-data line of the sensing data may have erroneous values. In this case, the OLED display device may not operate normally, or the pixels driven by the image data adjusted based on the particular sensing-data line may have excessively high luminance or excessively low luminance.

SUMMARY

Some embodiments provide a method of performing a sensing operation in an organic light emitting diode (OLED) display device capable of detecting a sensing error, and generating accurate sensing data.

Some embodiments provide an OLED display device capable of detecting a sensing error, and capable of generating accurate sensing data.

According to embodiments, there is provided a method of performing a sensing operation in an organic light emitting diode (OLED) display device including a plurality of pixels, the method including performing a one-line sensing operation for pixels in one line among the plurality of pixels, determining whether a sensing error occurs based on a result of the one-line sensing operation, when the sensing error is determined not to occur, performing a frame-sensing operation for all of the plurality of pixels, detecting an abnormal sensing-data line from among frame-sensing data generated by the frame-sensing operation, and replacing the abnormal sensing-data line by a data line generated based on at least one sensing-data line that is adjacent to the abnormal sensing-data line in the frame-sensing data.

Performing the one-line sensing operation may include applying a test voltage pattern to the pixels in the one line, receiving an output voltage pattern generated in response to the test voltage pattern from the pixels in the one line, and generating one-line sensing data corresponding to the output voltage pattern by performing analog-to-digital conversion on the output voltage pattern.

Determining whether the sensing error occurs may include comparing the output voltage pattern represented by the one-line sensing data with the test voltage pattern, and determining whether the sensing error occurs based on a result of the comparison.

The test voltage pattern may include first and second sensing voltages having a test voltage difference, and the sensing error may be determined to occur when an output voltage difference between first and second output voltages of the output voltage pattern represented by the one-line sensing data is different from the test voltage difference of the test voltage pattern.

The test voltage pattern may include a plurality of test voltage pulses having respective test voltage differences, and the sensing error may be determined to occur when output voltage differences of a plurality of output voltage pulses of the output voltage pattern represented by the one-line sensing data are different from the test voltage differences of the plurality of test voltage pulses of the test voltage pattern.

The test voltage pattern may include a plurality of first test voltage pulses having first test voltage differences, and a plurality of second test voltage pulses having second test voltage differences, and the sensing error may be determined to occur when first output voltage differences of a plurality of first output voltage pulses of the output voltage pattern represented by the one-line sensing data are different from the first test voltage differences of the plurality of first test voltage pulses of the test voltage pattern, or when second output voltage differences of a plurality of second output voltage pulses of the output voltage pattern represented by the one-line sensing data are different from the second test voltage differences of the plurality of second test voltage pulses of the test voltage pattern.

The method may further include, when the sensing error is determined to occur, displaying a sensing-error alarm image.

The method may further include, when the sensing error is determined to occur, transferring a sensing-error alarm signal to a host of the OLED display device.

The method may further include, when the sensing error is determined to occur, performing the one-line sensing operation and determining whether the sensing error occurs are repeated N times, where N is an integer greater than 1.

Detecting the abnormal sensing-data line from among the frame-sensing data may include detecting a line edge as the abnormal sensing-data line by performing a first-order differential operation on the frame-sensing data.

The method may further include determining that the sensing error occurs when a number of the abnormal sensing-data lines, or a width of the abnormal sensing-data line, detected from among the frame-sensing data is greater than or equal to a reference number or a reference width.

When the number of the abnormal sensing-data lines, or the width of the abnormal sensing-data line, is greater than or equal to the reference number or the reference width, performing the frame-sensing operation, detecting the abnormal sensing-data line, and comparing the number or the width of the abnormal sensing-data line with the reference number or the reference width may be repeated N times, where N is an integer greater than 1.

Replacing the abnormal sensing-data line may include generating an average sensing-data line by calculating an average of a first sensing-data line that is directly previous to the abnormal sensing-data line and a second sensing-data line that is directly subsequent to the abnormal sensing-data line, and replacing the abnormal sensing-data line by the average sensing-data line.

Replacing the abnormal sensing-data line may include generating an average sensing-data line by calculating an average of first M sensing-data lines that are previous to the abnormal sensing-data line and second M sensing-data lines that are subsequent to the abnormal sensing-data line, where M is an integer that is greater than 0, and replacing the abnormal sensing-data line by the average sensing-data line.

The abnormal sensing-data line may have a width of K, where K is an integer that is greater than 1, and replacing the abnormal sensing-data line may include generating a previous average sensing-data line by calculating an average of first M sensing-data lines that are previous to the abnormal sensing-data line, where M is an integer that is greater than 1, generating a subsequent average sensing-data line by calculating an average of second M sensing-data lines that are subsequent to the abnormal sensing-data line, generating K interpolated sensing-data lines by linearly interpolating between the previous average sensing-data line and the subsequent average sensing-data line, and replacing the abnormal sensing-data line having the width of K by the K interpolated sensing-data lines in the frame-sensing data.

The one line may be one horizontal line or one vertical line, and the one-line sensing operation may be performed on the pixels in the one horizontal line, or the pixels in the one vertical line, among the plurality of pixels.

The one-line sensing operation may include a horizontal one-line sensing operation for the pixels in one horizontal line among the plurality of pixels, and a vertical one-line sensing operation for the pixels in one vertical line among the plurality of pixels.

The method may further include detecting the abnormal sensing-data line that is perpendicular to the one line by performing a first-order differential operation on one-line sensing data generated by the one-line sensing operation, and determining that the sensing error occurs when a number of the abnormal sensing-data lines, or a width of the abnormal sensing-data line, detected based on the one-line sensing data is greater than or equal to a reference number or a reference width.

According to embodiments, there is provided a method of performing a sensing operation in an organic light emitting diode (OLED) display device including a plurality of pixels, the method including applying a test voltage pattern to pixels in one line among the plurality of pixels, receiving an output voltage pattern generated in response to the test voltage pattern from the pixels in the one line, determining whether a sensing error occurs by comparing the output voltage pattern with the test voltage pattern, when the sensing error is determined not to occur, applying a sensing voltage to the plurality of pixels, receiving a plurality of output voltages generated in response to the sensing voltage from the plurality of pixels, generating frame-sensing data by performing analog-to-digital conversion on the plurality of output voltages, detecting an abnormal sensing-data line from among the frame-sensing data, and replacing the abnormal sensing-data line by a data line generated based on at least one sensing-data line that is adjacent to the abnormal sensing-data line in the frame-sensing data.

According to embodiments, there is provided an organic light emitting diode (OLED) display device including a display panel including a plurality of pixels, a data driver configured to apply a test voltage pattern to pixels in one line among the plurality of pixels when a one-line sensing operation is performed, and to apply a sensing voltage to the plurality of pixels when a frame-sensing operation is performed, a sensing circuit configured to generate one-line sensing data corresponding to an output voltage pattern generated in response to the test voltage pattern when the one-line sensing operation is performed, and to generate frame-sensing data corresponding to a plurality of output voltages generated in response to the sensing voltage when the frame-sensing operation is performed, and a controller configured to determine whether a sensing error occurs by comparing the output voltage pattern represented by the one-line sensing data with the test voltage pattern, to detect an abnormal sensing-data line from among the frame-sensing data, and to replace the abnormal sensing-data line by a data line generated based on at least one sensing-data line that is adjacent to the abnormal sensing-data line in the frame-sensing data.

As described above, in a method of performing a sensing operation according to embodiments, and in an OLED display device according to embodiments, a one-line sensing operation may be performed before a frame-sensing operation is performed, and thus a sensing error may be previously detected by the one-line sensing operation.

Further, in the method of performing the sensing operation according to embodiments, and in the OLED display device according to embodiments, an abnormal sensing-data line may be detected from among frame-sensing data generated by the frame-sensing operation, the abnormal sensing-data line may be replaced using at least one adjacent sensing-data line, and thus accurate sensing data can be generated.

BRIEF DESCRIPTION OF THE DRAWINGS

Illustrative, non-limiting embodiments will be more clearly understood from the following detailed description in conjunction with the accompanying drawings.

FIG. 4A and FIG. 4B are diagrams illustrating examples of Prewitt masks that are used to detect an abnormal sensing-data line from among frame-sensing data.

DETAILED DESCRIPTION

Figure 1:
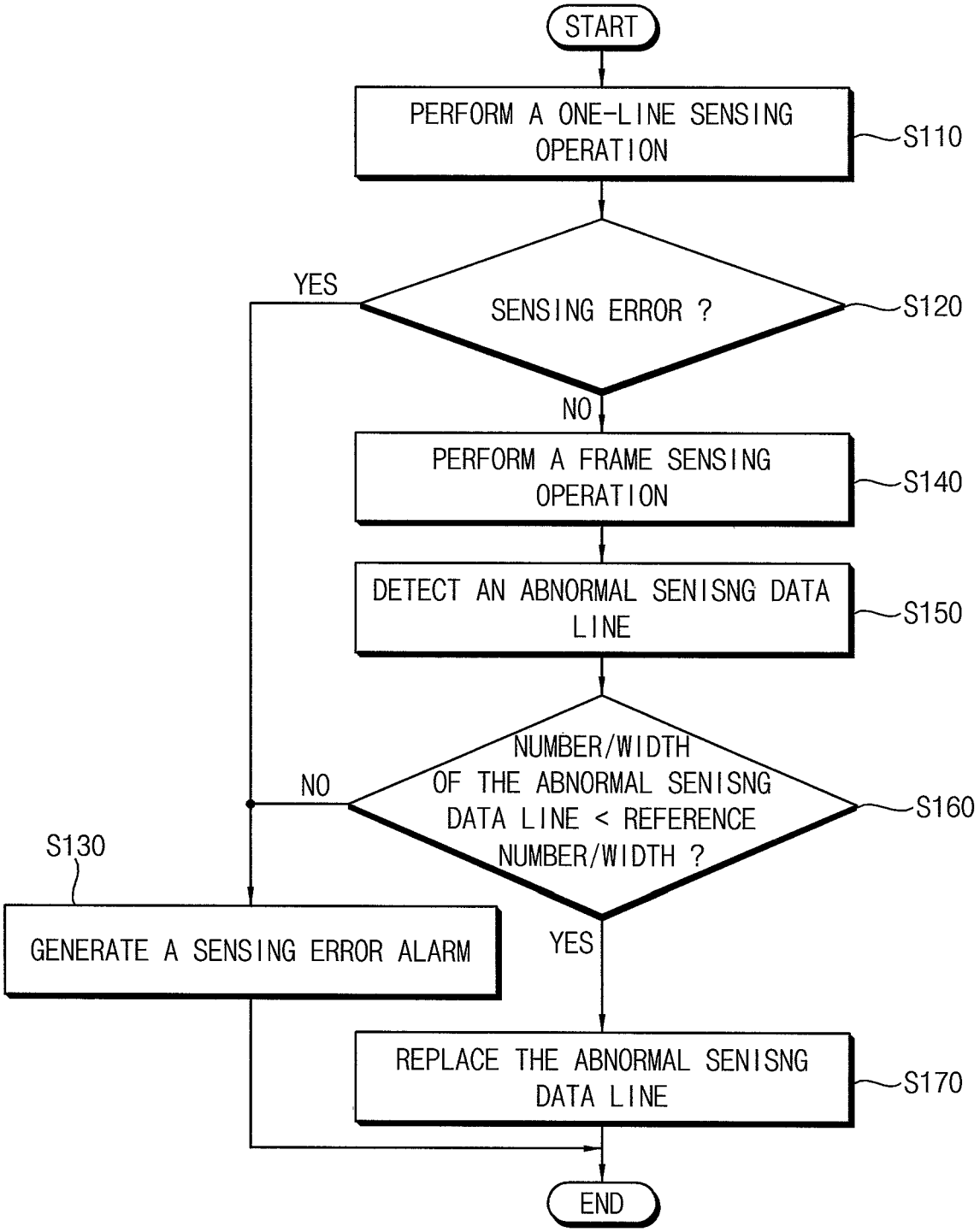
FIG. 1 is a flowchart illustrating a method of performing a sensing operation in an organic light emitting diode (OLED) display device according to embodiments.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2A:
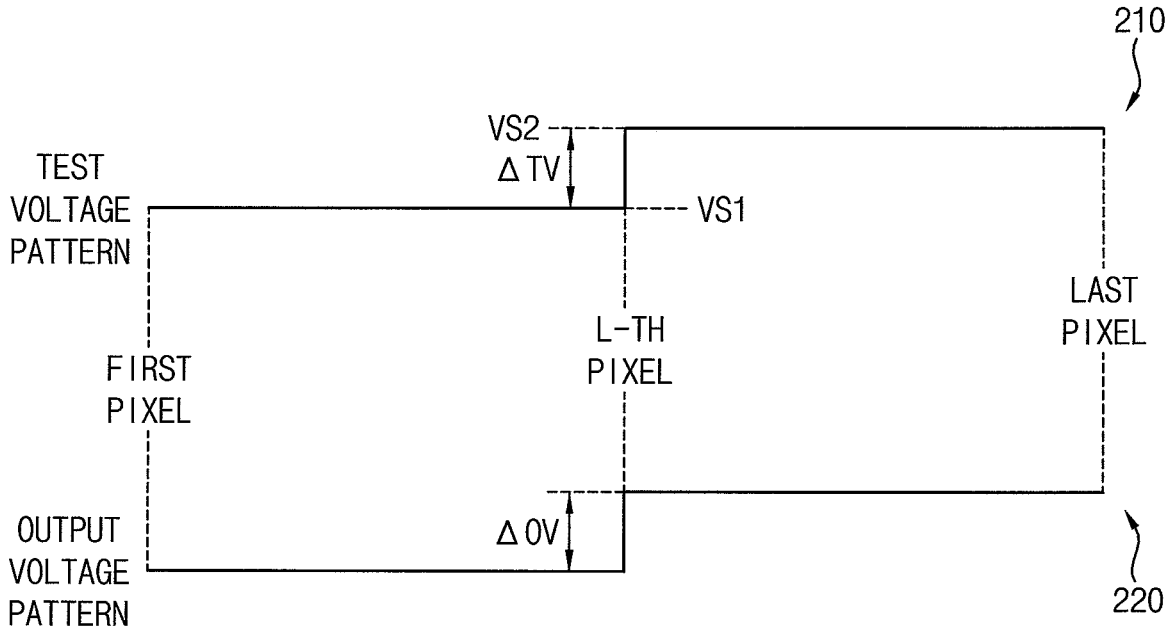
FIG. 2A is a diagram illustrating an example of a test voltage pattern and an output voltage pattern.
Figure 2B:
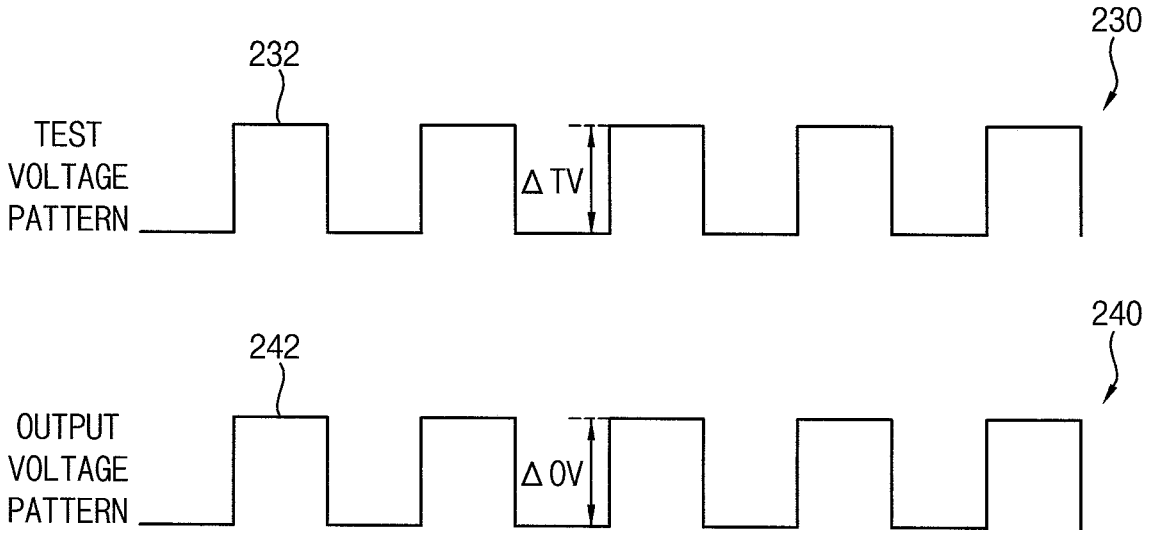
FIG. 2B is a diagram illustrating another example of a test voltage pattern and an output voltage pattern.
Figure 2C:
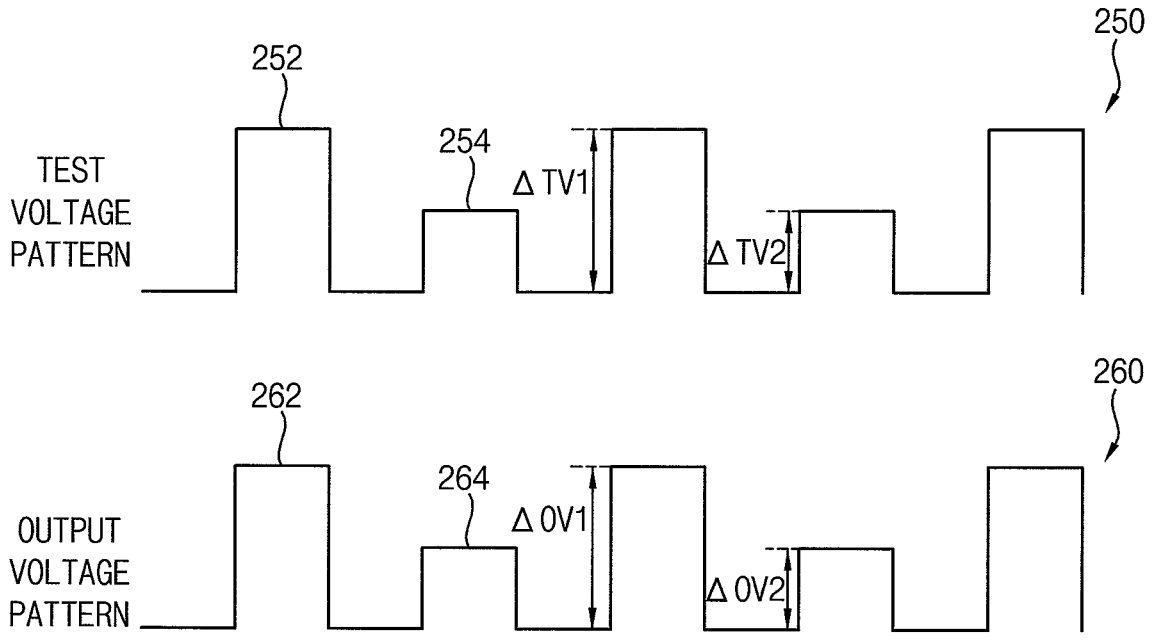
FIG. 2C is a diagram illustrating still another example of a test voltage pattern and an output voltage pattern.
Figure 3:
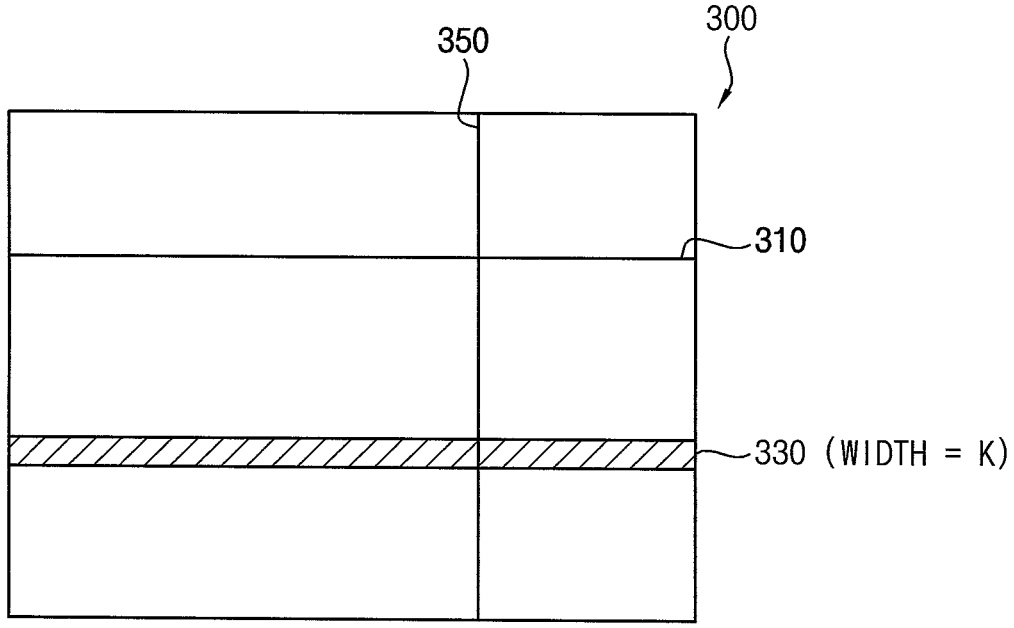
FIG. 3 is a diagram illustrating an example of frame-sensing data generated by a frame-sensing operation.
Figure 5A:
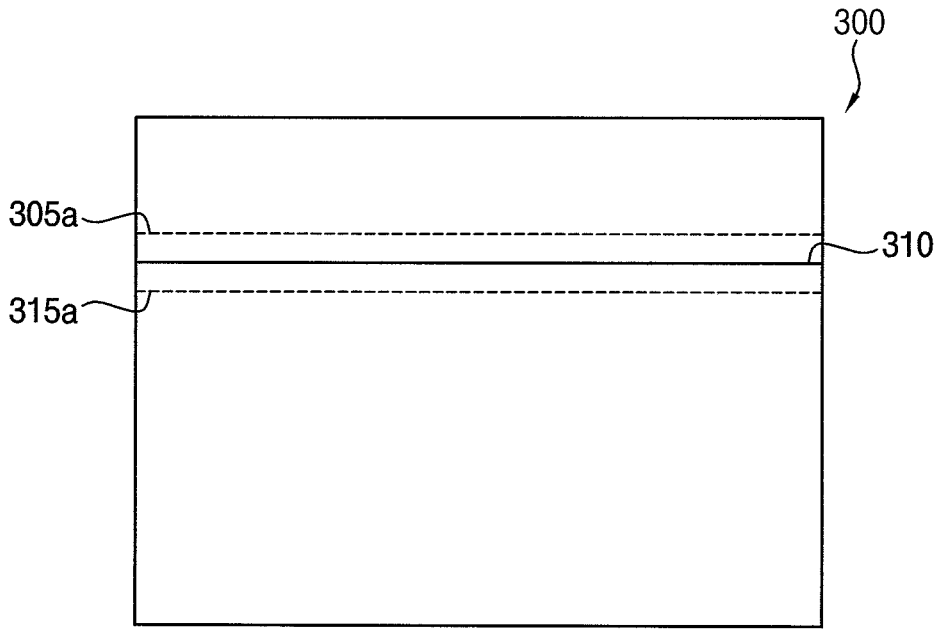
FIG. 5A is a diagram for describing an example where an abnormal sensing-data line is replaced by a data line generated based on adjacent sensing-data lines.
Figure 5B:
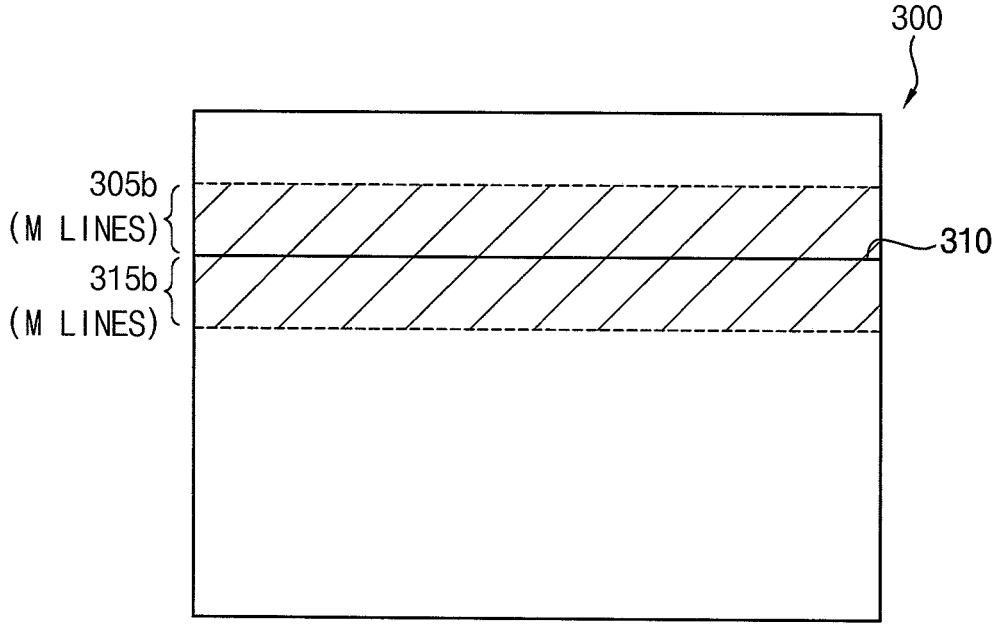
FIG. 5B is a diagram for describing another example where an abnormal sensing-data line is replaced by a data line generated based on adjacent sensing-data lines.
Figure 6A:
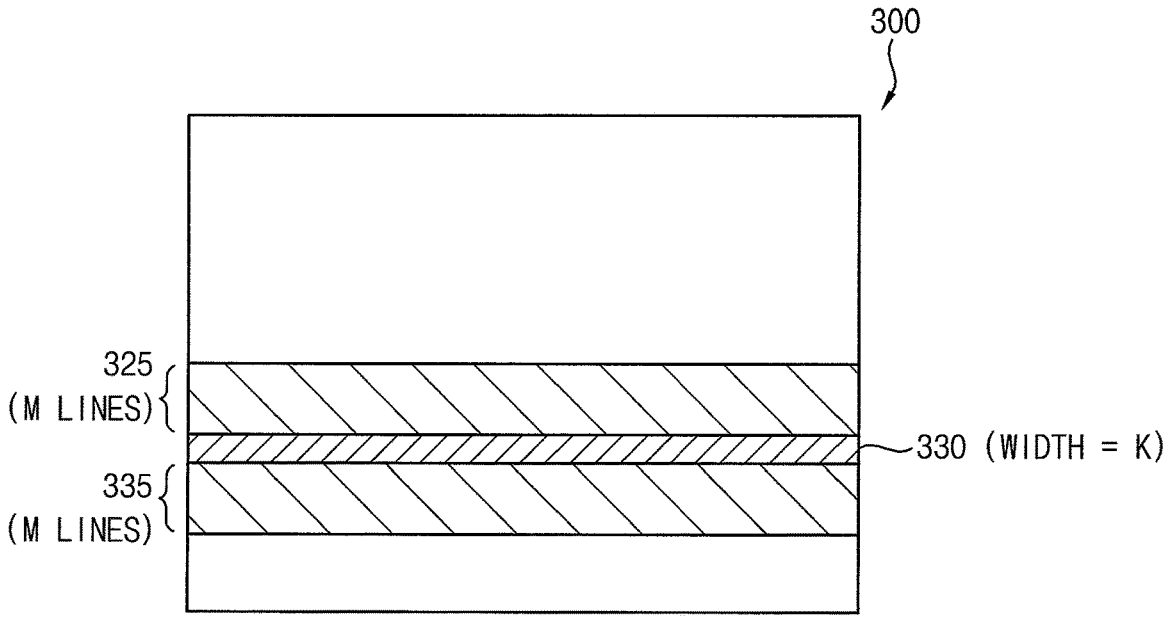
FIG. 6A and FIG. 6B are diagrams for describing an example where abnormal sensing-data lines having a width of K are replaced by data lines generated based on adjacent sensing-data lines.
Figure 6B:
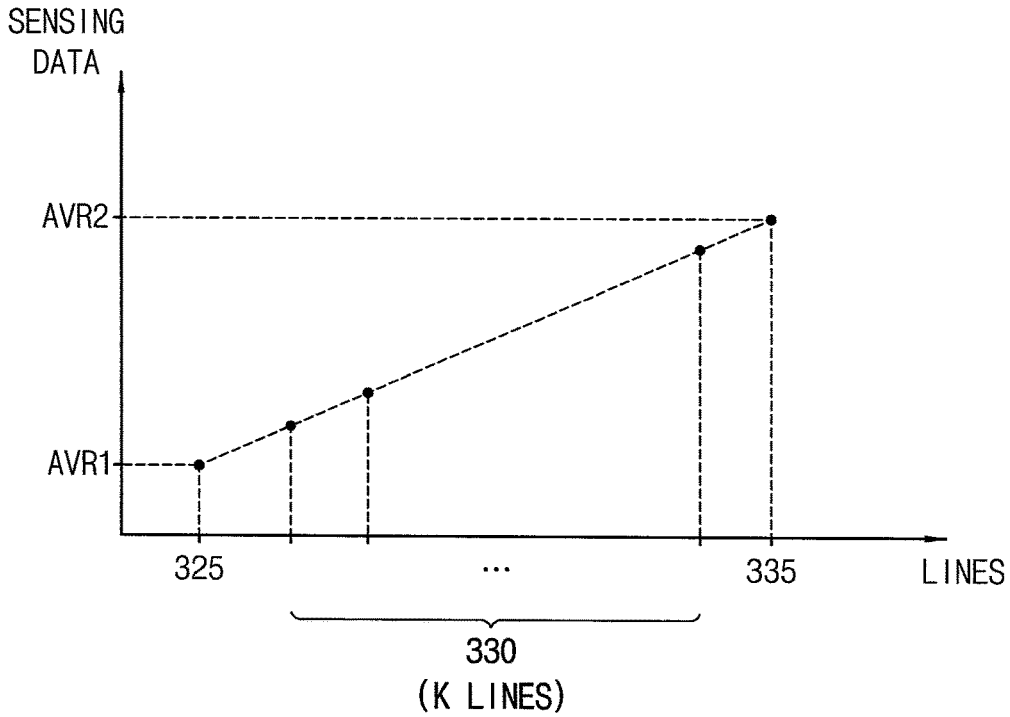

FIG. 1 is a flowchart illustrating a method of performing a sensing operation in an organic light emitting diode (OLED) display device according to embodiments, FIG. 2A is a diagram illustrating an example of a test voltage pattern and an output voltage pattern, FIG. 2B is a diagram illustrating another example of a test voltage pattern and an output voltage pattern, FIG. 2C is a diagram illustrating still another example of a test voltage pattern and an output voltage pattern, FIG. 3 is a diagram illustrating an example of frame-sensing data generated by a frame-sensing operation, FIG. 4A and FIG. 4B are diagrams illustrating examples of Prewitt masks that are used to detect an abnormal sensing-data line from among frame-sensing data, FIG. 5A is a diagram for describing an example where an abnormal sensing-data line is replaced by a data line generated based on adjacent sensing-data lines, FIG. 5B is a diagram for describing another example where an abnormal sensing-data line is replaced by a data line generated based on adjacent sensing-data lines, and FIG. 6A and FIG. 6B are diagrams for describing an example where abnormal sensing-data lines having a width of K are replaced by data lines generated based on adjacent sensing-data lines.

Referring to FIG. 1, in a method of performing a sensing operation in an organic light emitting diode (OLED) display device including a plurality of pixels, a one-line sensing operation (or a one-line sensing step) may be performed on pixels in one line among the plurality of pixels (S110). In some embodiments, the one line may be any one horizontal line, and the one-line sensing operation may be performed on the pixels (e.g., pixels connected to a same gate line) in the one horizontal line among the plurality of pixels. In other embodiments, the one line may be any one vertical line, and the one-line sensing operation may be performed on the pixels (e.g., pixels connected to a same data line) in the one vertical line among the plurality of pixels. In still other embodiments, the one-line sensing operation may include a horizontal one-line sensing operation for the pixels in the one horizontal line, and a vertical one-line sensing operation for the pixels in the one vertical line.

In some embodiments, to perform the one-line sensing operation, a data driver included in the OLED display device may apply a test voltage pattern to the pixels in the one line. The pixels in the one line may generate an output voltage pattern in response to the test voltage pattern. A sensing circuit included in the OLED display device may receive the output voltage pattern from the pixels in the one line, and may generate one-line sensing data corresponding to the output voltage pattern by performing analog-to-digital conversion on the output voltage pattern.

It may be determined whether a sensing error occurs based on a result of the one-line sensing operation (S120). In some embodiments, a controller included in the OLED display device may receive the one-line sensing data corresponding to the output voltage pattern from the sensing circuit, may compare the output voltage pattern represented by the one-line sensing data with the test voltage pattern, and may determine whether the sensing error occurs based on a result of the comparison. Here, the sensing error may cause desired sensing data to not be generated by the sensing operation according to embodiments, and may cause an image to not be normally displayed by the OLED display device due to inaccurate sensing data being generated by the sensing operation. For example, this sensing error may be caused by various defects, such as a defect of a sensing line, a defect of the sensing circuit, a defect of the data driver, etc.

In some embodiments, as illustrated in FIG. 2A, the test voltage pattern 210 may include first and second sensing voltages VS1 and VS2 having a test voltage difference ΔTV. For example, the data driver may apply the first sensing voltage VS1 to first through (L−1)-th pixels among the pixels in the one line, and may apply the second sensing voltage VS2, which has the test voltage difference ΔTV with respect to the first sensing voltage VS1, to L-th through last pixels among the pixels in the one line, where L is an integer that is greater than 1.

The pixels in the one line may output the output voltage pattern 220 having an output voltage difference (e.g., a difference between first and second output voltages of the output voltage pattern) ΔOV in response to the test voltage pattern 210 having the test voltage difference ΔTV. The sensing circuit may output the one-line sensing data corresponding to the output voltage pattern 220, and the controller may determine whether the sensing error occurs by comparing the output voltage pattern 220 represented by the one-line sensing data with the test voltage pattern 210. For example, the controller may detect the output voltage difference ΔOV of the output voltage pattern 220 by calculating a voltage deference between an average of output voltages output from the first through (L−1)-th pixels and an average of output voltages output from the L-th through last pixels, and may determine that the sensing error occurs if the output voltage difference ΔOV of the output voltage pattern 220 is different (e.g., different by more than a predetermined reference voltage difference) from the test voltage difference ΔTV of the test voltage pattern 210.

In other embodiments, as illustrated in FIG. 2B, the test voltage pattern 230 may include a plurality of test voltage pulses 232 each having a test voltage difference ΔTV (e.g., a difference between a maximum and a minimum of the pulse). The data driver may apply the test voltage pattern 230 to the pixels in the one line, the pixels in the one line may output the output voltage pattern 240 having a plurality of output voltage pulses 242 each having an output voltage difference ΔOV in response to the test voltage pattern 230, the sensing circuit may output the one-line sensing data corresponding to the output voltage pattern 240, and the controller may determine whether the sensing error occurs by comparing the output voltage pattern 240 represented by the one-line sensing data with the test voltage pattern 230. For example, the controller may determine that a sensing error occurs if any one of the output voltage differences ΔOV of the plurality of output voltage pulses 242 of the output voltage pattern 240 is different (e.g., different by more than a predetermined reference voltage difference) from the test voltage difference ΔTV of each of the plurality of test voltage pulses 232 of the test voltage pattern 230.

In still other embodiments, as illustrated in FIG. 2C, the test voltage pattern 250 may alternately include a plurality of first test voltage pulses 252 each having a first test voltage difference ΔTV1, and a plurality of second test voltage pulses 254 each having a second test voltage difference ΔTV2. The data driver may apply the test voltage pattern 250 to the pixels in the one line, the pixels in the one line may output the output voltage pattern 260 alternately including a plurality of first output voltage pulses 262, each of which having a first output voltage difference ΔOV1, and a plurality of second output voltage pulses 264 each having a second output voltage difference ΔOV2, the sensing circuit may output the one-line sensing data corresponding to the output voltage pattern 260, and the controller may determine whether the sensing error occurs by comparing the output voltage pattern 260 represented by the one-line sensing data with the test voltage pattern 250. For example, the controller may determine that the sensing error occurs if any one of the first output voltage differences ΔOV1 of the plurality of first output voltage pulses 262 of the output voltage pattern 260 is different (e.g., different by more than a predetermined reference voltage difference) from the first test voltage difference ΔTV1 of each of the plurality of first test voltage pulses 252 of the test voltage pattern 250, or if any one of the second output voltage differences ΔOV2 of the plurality of second output voltage pulses 264 of the output voltage pattern 260 is different (e.g., different by more than a predetermined reference voltage difference) from the second test voltage difference ΔTV2 of each of the plurality of second test voltage pulses 254 of the test voltage pattern 250.

If the sensing error is determined to occur (S120: YES), a sensing-error alarm may be generated (S130). In some embodiments, if the sensing error is determined to occur, a sensing-error alarm image may be displayed. In other embodiments, if the sensing error is determined to occur, the controller may transfer a sensing-error alarm signal to a host (e.g., an application processor (AP) or a test board) of the OLED display device. In response to the sensing-error alarm signal, the host may output an alarm sound, or may turn on a light emitting diode (LED) for alarm display. For example, the method of performing the sensing operation in the OLED display device may be performed when the OLED display device is manufactured, and the test board for the OLED display device may turn on the LED for alarm display if the sensing error occurs in the OLED display device. In this case, the OLED display device where the sensing error occurs may be discarded as a defective product.

In another example, after the OLED display device is sold to a user, the method of performing the sensing operation in the OLED display device may be performed when the OLED display device is powered on, or when the user selects a sensing mode. If the sensing error occurs in the OLED display device, an electronic device including the OLED display device may output the alarm sound using a speaker of the electronic device, or may display the sensing-error alarm image in the OLED display device. In this case, the user may request a repair of the OLED display device in a repair center for the OLED display device.

In some embodiments, if the sensing error is determined to occur (S120: YES), the one-line sensing operation (S110) and the step of determining whether the sensing error occurs (S120) may be repeated N times, where N is an integer that is greater than 1. For example, if all results of the N one-line sensing operations represent that the sensing error occurs, subsequent operations may not proceed, and the sensing operation may be terminated.

As described above, because the one-line sensing operation (S110) is performed before a frame-sensing operation (or frame-sensing step) (S140) is performed, the sensing error may be previously detected by the one-line sensing operation (e.g., detected prior to any frame-sensing operation), and thus it may be determined whether the OLED display device has a defect (e.g., the defect of the sensing line, the defect of the sensing circuit, the defect of the data driver, etc.), which may cause the sensing error.

If the sensing error is determined to not occur (S120: NO), the frame-sensing operation for all of the plurality of pixels may be performed (S140). In some embodiments, the frame-sensing operation may be sequentially performed on the plurality of pixels on a pixel row basis. For example, the data driver may sequentially apply substantially the same sensing voltage to the plurality of pixels on the pixel row basis, and the sensing circuit may sequentially receive a plurality of output voltages from the plurality of pixels on the pixel row basis. Further, the sensing circuit may sequentially provide the controller with frame-sensing data corresponding to the plurality of output voltages on the pixel row basis by sequentially performing analog-to-digital conversion on the plurality of output voltages on the pixel row basis.

An abnormal sensing-data line may be detected from among the frame-sensing data generated by the frame-sensing operation (S150). For example, FIG. 3 illustrates an example where the frame-sensing data 300 generated by the frame-sensing operation may include at least one abnormal sensing-data line 310, 330, and 350. In FIG. 3, a horizontal abnormal sensing-data line 310 having a width of 1, a horizontal abnormal sensing-data line 330 having a width of K, and a vertical abnormal sensing-data line 350 having a width of 1 are illustrated, where K is an integer that is greater than 1. For example, the vertical abnormal sensing-data line 350 may be caused by, but may not be limited to, a defect of a sensing line extending in a vertical direction and connected to pixels in one column. Further, for example, the horizontal abnormal sensing-data lines 310 and 330 may be caused by, but may not be limited to, a defect of a scan line, a defect of a scan driver, etc. The pixels driven by image data adjusted based on these abnormal sensing-data lines 310, 330, and 350 may have excessively high luminance or excessively low luminance.

In some embodiments, to detect the abnormal sensing-data lines 310, 330, and 350 from among the frame-sensing data 300, the controller may detect line edges as the abnormal sensing-data lines 310, 330, and 350 by performing a first-order differential operation on the frame-sensing data 300. For example, the controller may detect the abnormal sensing-data lines 310, 330, and 350 by using, as a first-order differential operator, a Prewitt mask, a Sobel mask, a Roberts mask, or the like. In an example, the vertical abnormal sensing-data line 350 may be detected using a Prewitt mask 410 illustrated in FIG. 4A, and the horizontal abnormal sensing-data lines 310 and 330 may be detected using a Prewitt mask 430 illustrated in FIG. 4B. However, the first-order differential operator may not be limited to examples of FIG. 4A and FIG. 4B. Further, although 5×5 masks 410 and 430 are illustrated in FIG. 4A and FIG. 4B, according to embodiments, masks having any size may be used. For example, 1×P masks or P×1 masks may be used, where P is an integer that is greater than 2.

In some embodiments, it may be further determined whether the abnormal sensing-data line 310, 330, and 350 is a critical (e.g., severe) abnormal sensing-data line (S160). For example, if the number of the abnormal sensing-data lines 310, 330, and 350 detected from among the frame-sensing data 300 is greater than or equal to a reference number, or if a width of the abnormal sensing-data line 310, 330, and 350 detected from among the frame-sensing data 300 is greater than or equal to a reference width (S160: NO), it may be determined that the sensing error occurs, and the sensing-error alarm may be generated (S130). In some embodiments, if the number or the width of the abnormal sensing-data line 310, 330, and 350 is greater than or equal to the reference number or the reference width, performing the frame-sensing operation (S140), detecting the abnormal sensing-data line (S150), and comparing the number or the width of the abnormal sensing-data line with the reference number or the reference width (S160) may be repeated N times, where N is an integer that is greater than 1. If all results of the frame-sensing operations indicate that the sensing error occurs, subsequent operations might not proceed, and the sensing operation may be terminated.

If the abnormal sensing-data line 310, 330, and 350 is not a severe abnormal sensing-data line, or if the number and the width of the abnormal sensing-data line 310, 330, and 350 is less than the reference number and the reference width (S160: YES), the abnormal sensing-data line 310, 330, and 350 may be replaced by a data line that is generated based on at least one sensing-data line that is adjacent to the abnormal sensing-data line 310, 330, and 350 in the frame-sensing data 300 (S170) (e.g. a line of data corresponding to an abnormal line of pixels may be replaced by a line of data that is generated based on at least one adjacent line of data corresponding to at least one line of pixels that is adjacent to the abnormal line of pixels).

In some embodiments, as illustrated in FIG. 5A, an average sensing-data line may be generated by calculating an average of a first sensing-data line 305*a*, which is directly previous to, or prior to, the abnormal sensing-data line 310, and a second sensing-data line 315*a*, which is directly next to, or subsequent to, the abnormal sensing-data line 310, and the abnormal sensing-data line 310 may be replaced by the average sensing-data line. Accordingly, the abnormal sensing-data line 310 may be removed from the frame-sensing data 300, an appropriate sensing-data line generated based on the adjacent sensing-data lines 305*a* and 315*a* may be inserted into the frame-sensing data 300, and thus an image displayed in response to the image data adjusted based on the frame-sensing data 300 may not have the excessively high luminance or the excessively low luminance.

In other embodiments, as illustrated in FIG. 5B, an average sensing-data line may be generated by calculating an average of first M sensing-data lines 305*b* that are previous to the abnormal sensing-data line 310, and second M sensing-data lines 315*b* that are subsequent to the abnormal sensing-data line 310, where M is an integer that is greater than 0, and the abnormal sensing-data line 310 may be replaced by the average sensing-data line in the frame-sensing data 300.

In still other embodiments, with respect to the abnormal sensing-data line 300 having a width of K, where K is an integer that is greater than 1, or with respect to the abnormal sensing-data line 300 including K consecutive lines, as illustrated in FIG. 6A and FIG. 6B, a previous average sensing-data line AVR1 may be generated by calculating an average of first M sensing-data lines 325 that are previous to the abnormal sensing-data line 330, where M is an integer that is greater than 1, a next average sensing-data line, or subsequent average sensing-data line, AVR2 may be generated by calculating an average of second M sensing-data lines 335 that are subsequent to the abnormal sensing-data line 330, K interpolated sensing-data lines may be generated by linearly interpolating between the previous average sensing-data line AVR1 and the next average sensing-data line AVR2, and the abnormal sensing-data line 330 having the width of K may be replaced by the K interpolated sensing-data lines in the frame-sensing data 300.

However, embodiments disclosed herein are not limited to the examples illustrated in FIG. 5A through FIG. 6B, and each abnormal sensing-data line 310, 330, and 350 may be replaced by any adjacent abnormal sensing-data line, or by a data line generated based on any adjacent abnormal sensing-data line.

As described above, in the method of performing the sensing operation according to embodiments, the one-line sensing operation may be performed before the frame-sensing operation is performed, and thus the sensing error may be previously detected by the one-line sensing operation. Further, in the method of performing the sensing operation according to embodiments, the abnormal sensing-data line 310, 330, and 350 may be detected from among the frame-sensing data 300 generated by the frame-sensing operation, the abnormal sensing-data line 310, 330, and 350 may be replaced using at least one adjacent sensing-data line, and thus accurate sensing data can be generated.

Figure 7:
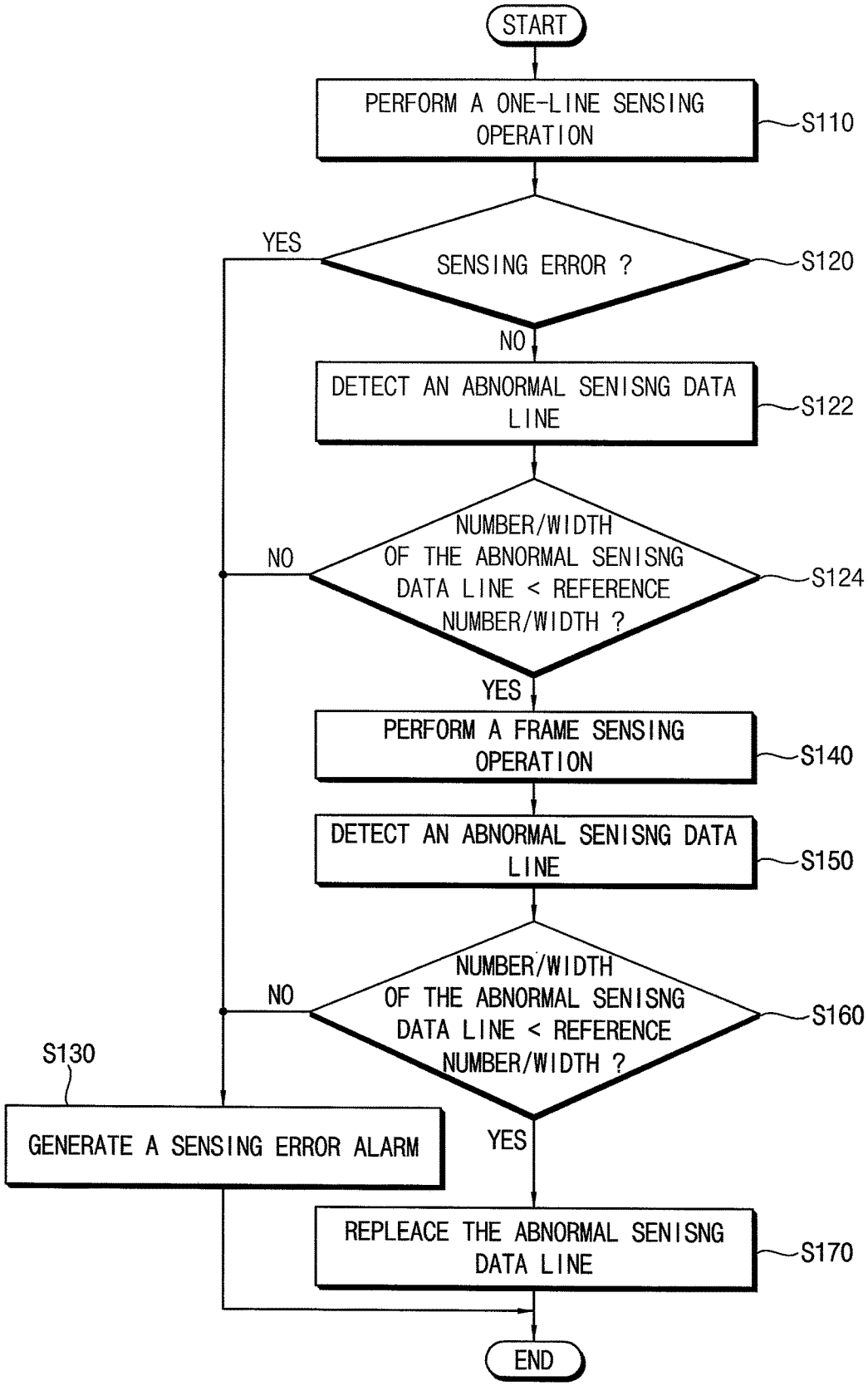
FIG. 7 is a flowchart illustrating a method of performing a sensing operation in an OLED display device according to embodiments.
Figure 8:
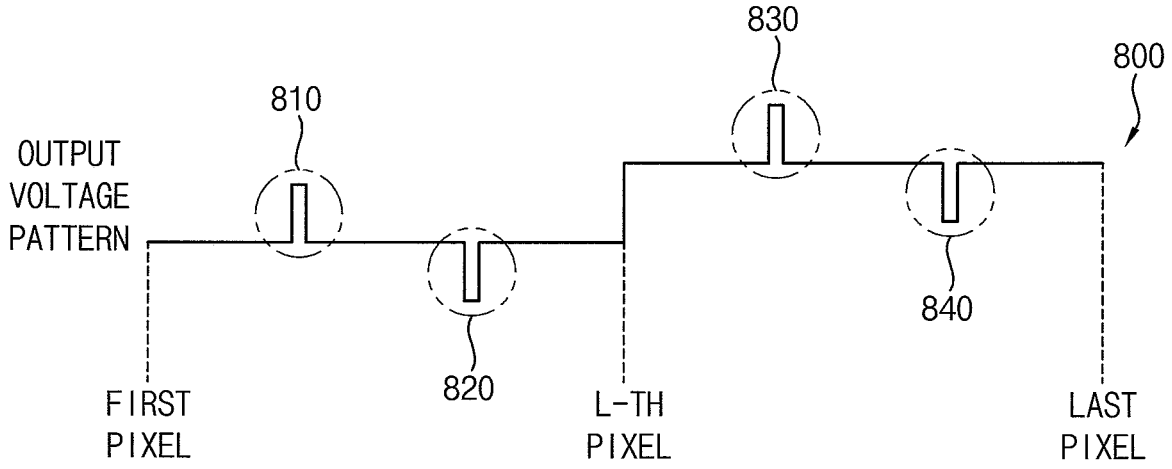
FIG. 8 is a diagram illustrating an example of an output voltage pattern.

FIG. 7 is a flowchart illustrating a method of performing a sensing operation in an OLED display device according to embodiments, and FIG. 8 is a diagram illustrating an example of an output voltage pattern.

Compared with a method of performing a sensing operation illustrated in FIG. 1, a method of performing a sensing operation illustrated in FIG. 7 may further include detecting an abnormal sensing-data line using a result of a one-line sensing operation (S122), and detecting a sensing error based on the number of the detected abnormal sensing data lines, or based on a width of the detected abnormal sensing-data line (S124).

One-line sensing data may be generated by the one-line sensing operation for pixels in one line (S110), and it may be determined whether the sensing error occurs by comparing an output voltage pattern represented by the one-line sensing data with a test voltage pattern (S120). Further, in the method of performing the sensing operation illustrated in FIG. 7, the abnormal sensing-data line may be detected based on the one-line sensing data generated by the one-line sensing operation (S122). For example, the abnormal sensing-data line, which is perpendicular to the one line, may be detected by performing a first-order differential operation on the one-line sensing data generated by the one-line sensing operation.

In some embodiments, the one line may be a horizontal line, and a vertical abnormal sensing-data line may be detected by the first-order differential operation on the one-line sensing data. In other embodiments, the one line may be a vertical line, and a horizontal abnormal sensing-data line may be detected by the first-order differential operation on the one-line sensing data. In still other embodiments, both of a horizontal one-line sensing operation for pixels in one horizontal line and a vertical one-line sensing operation for pixels in one vertical line are performed, and both of the vertical abnormal sensing-data line and the horizontal abnormal sensing-data line may be detected by performing both of the first-order differential operation on the one-line sensing data generated by the horizontal one-line sensing operation and the first-order differential operation on the one-line sensing data generated by the vertical one-line sensing operation.

If the number of abnormal sensing data lines, or a width of the abnormal sensing-data line, detected based on the one-line sensing data is greater than or equal to a reference number or a reference width (S124: NO), it may be determined that a sensing error occurs, and a sensing-error alarm may be generated (S130). For example, in a case where a test voltage pattern 210 illustrated in FIG. 2A is applied to the pixels in the one line, and the pixels in the one line output an output voltage pattern 800 illustrated in FIG. 8 in response to the test voltage pattern 210 illustrated in FIG. 2A, a voltage deference between an average of output voltages output from first through (L−1)-th pixels and an average of output voltages output from L-th through last pixels may be similar to a test voltage difference ΔTV of the test voltage pattern 210, and thus the sensing error may be erroneously determined to not occur.

However, in the method of performing the sensing operation according to embodiments, the abnormal sensing-data lines 810, 820, 830 and 840 may be detected by performing the first-order differential operation on the one-line sensing data generated by the horizontal one-line sensing operation. If the number (or a width) of the abnormal sensing-data lines 810, 820, 830 and 840 is greater than or equal to the reference number (or the reference width) (S124: NO), the sensing error may be determined to occur, and the sensing-error alarm may be generated (S130). Accordingly, before a frame-sensing operation is performed (S140), the sensing error may be previously detected.

Figure 9:
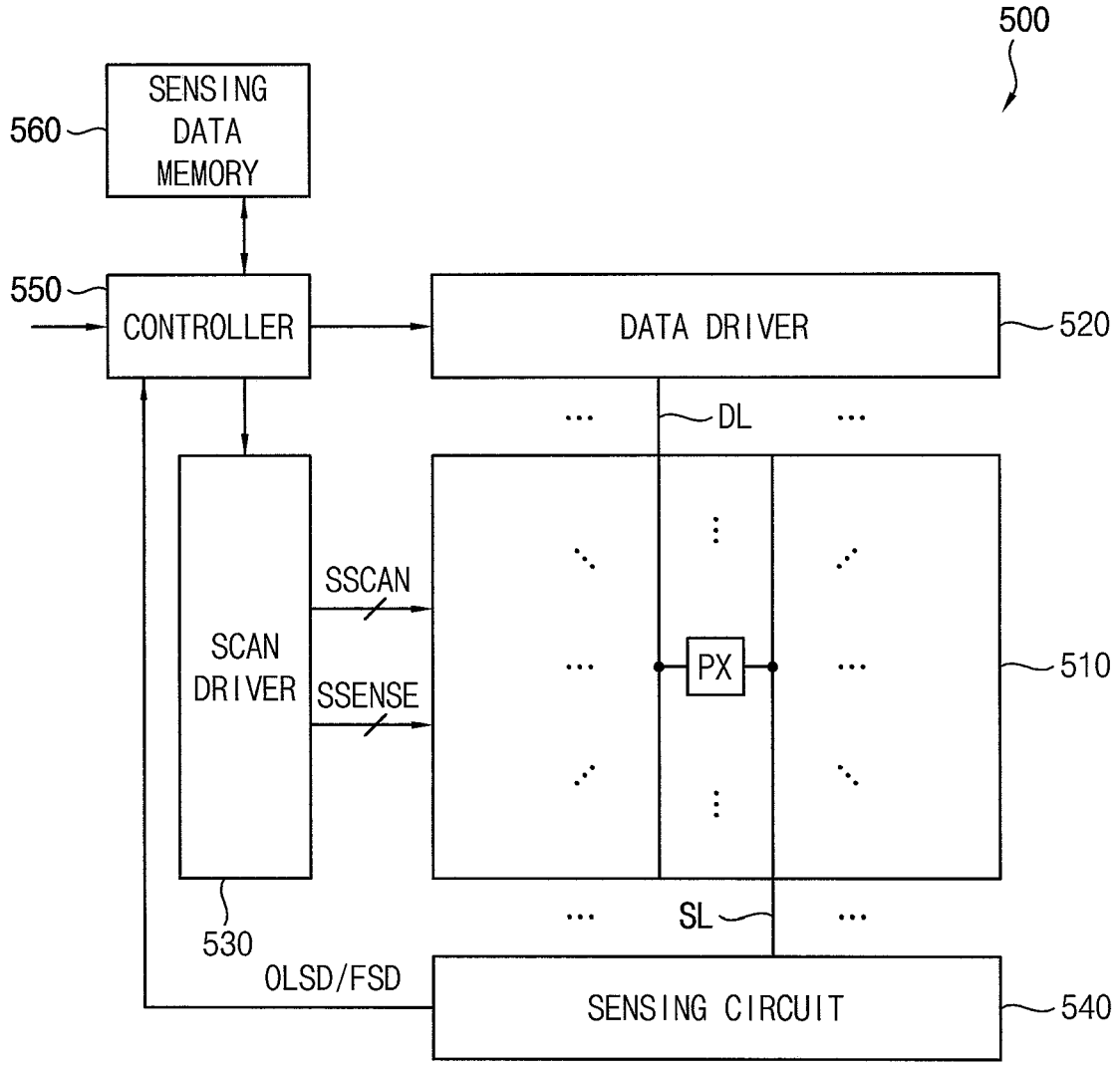
FIG. 9 is a block diagram illustrating an OLED display device according to embodiments.
Figure 10:
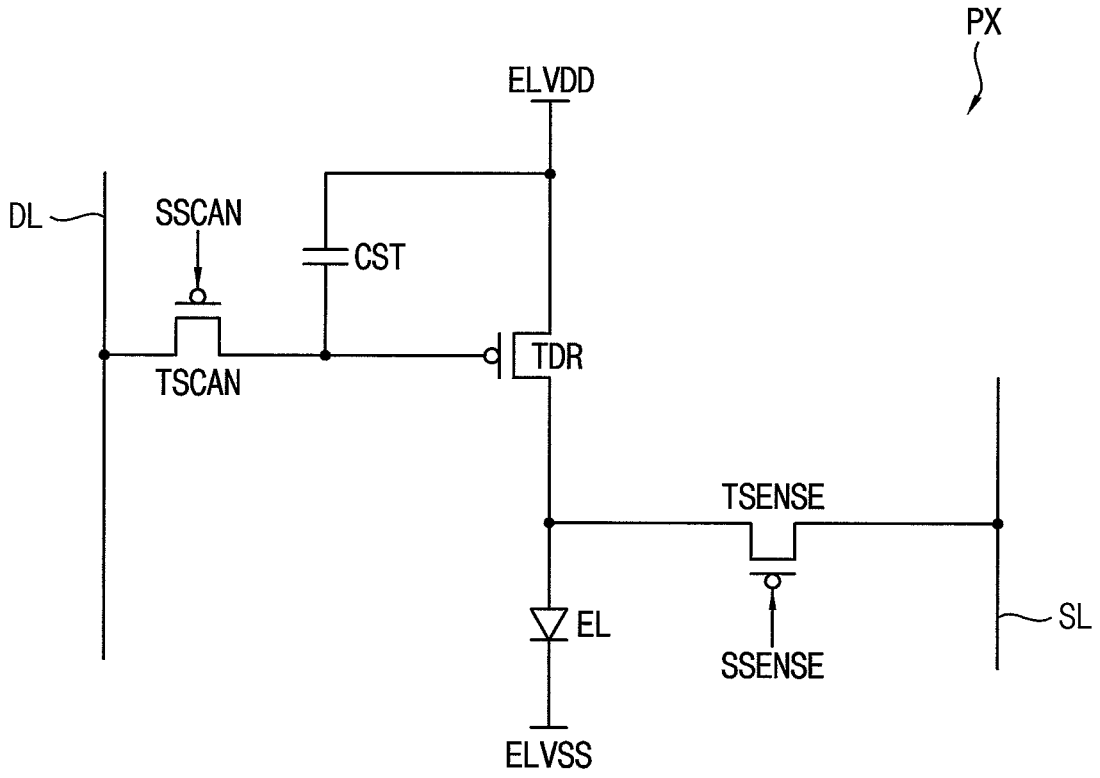
FIG. 10 is a circuit diagram illustrating an example of each pixel included in an OLED display device of FIG. 9.

FIG. 9 is a block diagram illustrating an OLED display device according to embodiments, and FIG. 10 is a circuit diagram illustrating an example of each pixel included in an OLED display device of FIG. 9.

Referring to FIG. 9, a display device 500 according to embodiments may include a display panel 510, a data driver 520, a scan driver 530, a sensing circuit 540, a controller 550, and a sensing data memory 560.

The display panel 510 may include a plurality of data lines DL, a plurality of scan lines, a plurality of sensing control lines, a plurality of sensing lines SL, and a plurality of pixels PX respectively coupled to respective ones of the plurality of data lines DL, the plurality of scan lines, the plurality of sensing control lines, and the plurality of sensing lines SL. In some embodiments, each pixel PX may include an organic light emitting diode (OLED), and the display panel 510 may be an OLED panel.

In some embodiments, as illustrated in FIG. 10, each pixel PX of the display panel 510 may include a scan transistor TSCAN that transfers a voltage transferred through the data line DL in response to a scan signal SSCAN, a storage capacitor CST that stores the voltage transferred by the scan transistor TSCAN, a driving transistor TDR that generates a driving current based on the voltage stored in the storage capacitor CST, the OLED EL that emits light in response to the driving current flowing from a line of a first power supply voltage ELVDD to a line of a second power supply voltage ELVSS, and a sensing transistor TSENSE that connects the driving transistor TDR to the sensing line SL in response to a sensing signal SSENSE. However, a configuration of the pixel PX according to embodiments may not be limited to the example of FIG. 10.

The data driver 520 may provide a data voltage or a sensing voltage to the plurality of pixels PX based on a control signal and image data received from the controller 550. In some embodiments, the control signal provided to the data driver 520 may include, but is not limited to, a horizontal start signal and a load signal. In some embodiments, the data driver 520 may apply a test voltage pattern to pixels PX in one line among the plurality of pixels PX when a one-line sensing operation is performed, and may apply substantially the same sensing voltage to the plurality of pixels PX when a frame-sensing operation is performed.

The scan driver 530 may provide the scan signal SSCAN and the sensing signal SSENSE to the plurality of pixels PX based on a control signal received from the controller 550. In some embodiments, the control signal provided to the scan driver 530 may include, but is not limited to, a scan enable signal and a scan clock signal.

The sensing circuit 540 may receive a plurality of output voltages generated in response to the sensing voltage from the plurality of pixels PX through the plurality of sensing lines SL, and may generate sensing data OLSD and FSD corresponding to the plurality of output voltages. In some embodiments, the sensing circuit 540 may generate one-line sensing data OLSD corresponding to an output voltage pattern generated in response to the test voltage pattern when the one-line sensing operation is performed, and may generate frame-sensing data FSD corresponding to the plurality of output voltages generated in response to the sensing voltage when the frame-sensing operation is performed. In some embodiments, the sensing circuit 540 may include, but is not limited to, an analog-to-digital converter (ADC) for converting the plurality of output voltages into the sensing data OLSD and FSD.

The controller (e.g., a timing controller "TCON") 550 may control an operation of the display device 500. In some embodiments, when the one-line sensing operation is performed, the controller 550 may receive the one-line sensing data OLSD from the sensing circuit 540, and may determine whether a sensing error occurs by comparing the output voltage pattern represented by the one-line sensing data OLSD with the test voltage pattern. When the frame-sensing operation is performed, the controller 550 may receive the frame-sensing data FSD from the sensing circuit 540, may detect an abnormal sensing-data line from among the frame-sensing data FSD, and may replace the abnormal sensing-data line by a data line generated based on at least one sensing-data line adjacent to the abnormal sensing-data line in the frame-sensing data FSD. Further, the controller 550 may store the frame-sensing data FSD where the abnormal sensing-data line is replaced in the sensing data memory 560. When the display device 500 performs a normal operation after the one-line sensing operation and the frame-sensing operation are performed, the controller 550 may adjust (or correct) image data received from an external host based on the frame-sensing data FSD stored in the sensing data memory 560, and may provide the adjusted (or corrected) image data to the data driver 520. Because an image is displayed based on the adjusted (or corrected) image data, initial luminance non-uniformity and/or degradation of the display panel 510 may be compensated, and an image quality of the display device 500 may be improved.

Figure 11:
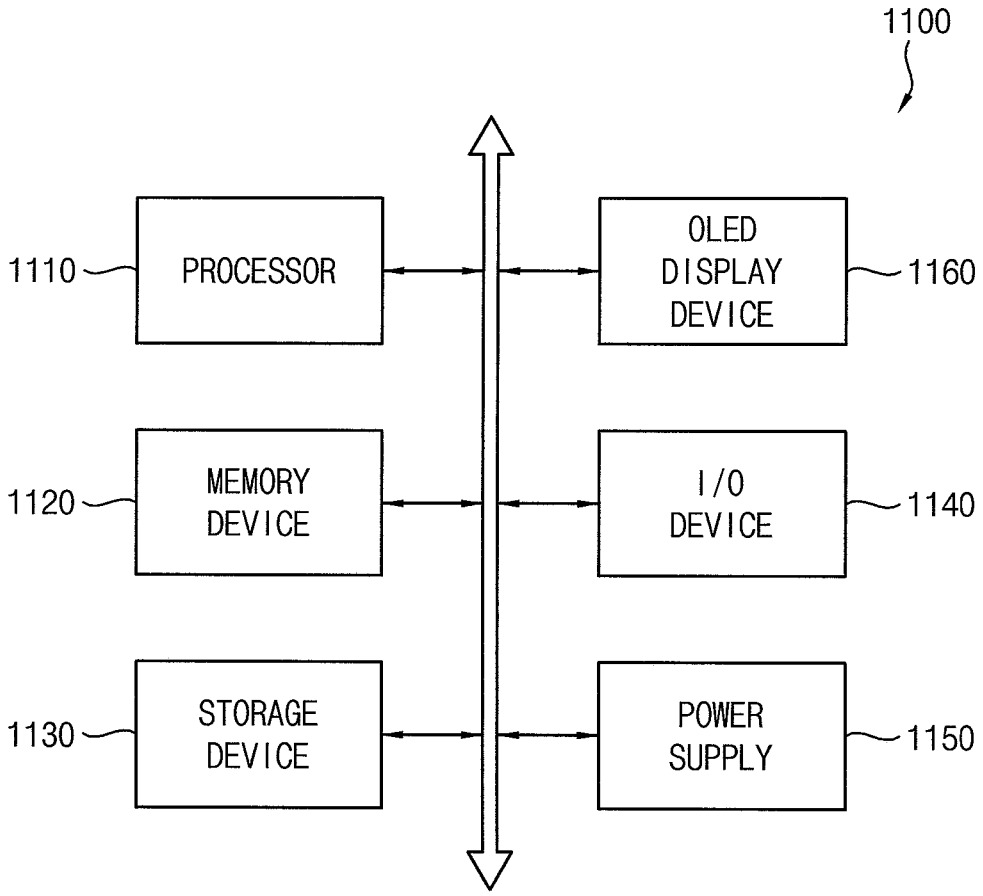
FIG. 11 is a block diagram illustrating an electronic device including an OLED display device according to embodiments.

FIG. 11 is a block diagram illustrating an electronic device including an OLED display device according to embodiments.

Referring to FIG. 11, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The OLED display device 1160 may be coupled to other components through the buses or other communication links.

In the OLED display device 1160, a one-line sensing operation may be performed before a frame-sensing operation is performed, and thus a sensing error may be previously detected by the one-line sensing operation. Further, in the OLED display device 1160, an abnormal sensing-data line may be detected from among frame-sensing data generated by the frame-sensing operation, the abnormal sensing-data line may be replaced using at least one adjacent sensing-data line, and thus accurate sensing data can be generated.

The inventive concepts may be applied to any electronic device 1100 including the OLED display device 1160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and aspects of the present disclosure. Accordingly, all such modifications are intended to be included within the scope of the present disclosure as defined in the claims. Therefore, it is to be understood that the foregoing is illustrative of various embodiments, and is not to be construed as limited to the specific embodiments disclosed, and that modifications to the disclosed embodiments, as well as other embodiments, are intended to be included within the scope of the appended claims along with functional equivalents thereof.

What is claimed is:

1. A method of performing a sensing operation in an organic light emitting diode (OLED) display device comprising a plurality of pixels, the method comprising:

performing a one-line sensing operation for pixels in one line among the plurality of pixels;

determining whether a sensing error occurs based on a result of the one-line sensing operation;

when the sensing error is determined not to occur, performing a frame-sensing operation for all of the plurality of pixels;

detecting an abnormal sensing-data line from among frame-sensing data generated by the frame-sensing operation; and replacing the abnormal sensing-data line by a data line generated based on at least one sensing-data line that is adjacent to the abnormal sensing-data line in the frame-sensing data.

2. The method of claim 1, wherein performing the one-line sensing operation comprises:

applying a test voltage pattern to the pixels in the one line;

receiving an output voltage pattern generated in response to the test voltage pattern from the pixels in the one line; and generating one-line sensing data corresponding to the output voltage pattern by performing analog-to-digital conversion on the output voltage pattern.

3. The method of claim 2, wherein determining whether the sensing error occurs comprises:

comparing the output voltage pattern represented by the one-line sensing data with the test voltage pattern; and determining whether the sensing error occurs based on a result of the comparison.

4. The method of claim 3, wherein the test voltage pattern comprises first and second sensing voltages having a test voltage difference, and wherein the sensing error is determined to occur when an output voltage difference between first and second output voltages of the output voltage pattern represented by the one-line sensing data is different from the test voltage difference of the test voltage pattern.

5. The method of claim 3, wherein the test voltage pattern comprises a plurality of test voltage pulses having respective test voltage differences, and wherein the sensing error is determined to occur when output voltage differences of a plurality of output voltage pulses of the output voltage pattern represented by the one-line sensing data are different from the test voltage differences of the plurality of test voltage pulses of the test voltage pattern.

6. The method of claim 3, wherein the test voltage pattern comprises a plurality of first test voltage pulses having first test voltage differences, and a plurality of second test voltage pulses having second test voltage differences, and wherein the sensing error is determined to occur when first output voltage differences of a plurality of first output voltage pulses of the output voltage pattern represented by the one-line sensing data are different from the first test voltage differences of the plurality of first test voltage pulses of the test voltage pattern, or when second output voltage differences of a plurality of second output voltage pulses of the output voltage pattern represented by the one-line sensing data are different from the second test voltage differences of the plurality of second test voltage pulses of the test voltage pattern.

7. The method of claim 1, further comprising, when the sensing error is determined to occur, displaying a sensing-error alarm image.

8. The method of claim 1, further comprising, when the sensing error is determined to occur, transferring a sensing-error alarm signal to a host of the OLED display device.

9. The method of claim 1, wherein, when the sensing error is determined to occur, performing the one-line sensing operation and determining whether the sensing error occurs are repeated N times, where N is an integer greater than 1.

10. The method of claim 1, wherein detecting the abnormal sensing-data line from among the frame-sensing data comprises detecting a line edge as the abnormal sensing-data line by performing a first-order differential operation on the frame-sensing data.

11. The method of claim 1, further comprising determining that the sensing error occurs when a number of the abnormal sensing-data lines, or a width of the abnormal sensing-data line, detected from among the frame-sensing data is greater than or equal to a reference number or a reference width.

12. The method of claim 11, wherein, when the number of the abnormal sensing-data lines, or the width of the abnormal sensing-data line, is greater than or equal to the reference number or the reference width, performing the frame-sensing operation, detecting the abnormal sensing-data line, and comparing the number or the width of the abnormal sensing-data line with the reference number or the reference width are repeated N times, where N is an integer greater than 1.

13. The method of claim 1, wherein replacing the abnormal sensing-data line comprises:

generating an average sensing-data line by calculating an average of a first sensing-data line that is directly previous to the abnormal sensing-data line and a second sensing-data line that is directly subsequent to the abnormal sensing-data line; and replacing the abnormal sensing-data line by the average sensing-data line.

14. The method of claim 1, wherein replacing the abnormal sensing-data line comprises:

generating an average sensing-data line by calculating an average of first M sensing-data lines that are previous to the abnormal sensing-data line and second M sensing-data lines that are subsequent to the abnormal sensing-data line, where M is an integer that is greater than 0; and replacing the abnormal sensing-data line by the average sensing-data line.

15. The method of claim 1, wherein the abnormal sensing-data line has a width of K, where K is an integer that is greater than 1, and wherein replacing the abnormal sensing-data line comprises:

generating a previous average sensing-data line by calculating an average of first M sensing-data lines that are previous to the abnormal sensing-data line, where M is an integer that is greater than 1;

generating a subsequent average sensing-data line by calculating an average of second M sensing-data lines that are subsequent to the abnormal sensing-data line;

generating K interpolated sensing-data lines by linearly interpolating between the previous average sensing-data line and the subsequent average sensing-data line; and replacing the abnormal sensing-data line having the width of K by the K interpolated sensing-data lines in the frame-sensing data.

16. The method of claim 1, wherein the one line is one horizontal line or one vertical line, and wherein the one-line sensing operation is performed on the pixels in the one horizontal line, or the pixels in the one vertical line, among the plurality of pixels.

17. The method of claim 1, wherein the one-line sensing operation comprises a horizontal one-line sensing operation for the pixels in one horizontal line among the plurality of pixels, and a vertical one-line sensing operation for the pixels in one vertical line among the plurality of pixels.

18. The method of claim 1, further comprising:

detecting the abnormal sensing-data line that is perpendicular to the one line by performing a first-order differential operation on one-line sensing data generated by the one-line sensing operation; and determining that the sensing error occurs when a number of the abnormal sensing-data lines, or a width of the abnormal sensing-data line, detected based on the one-line sensing data is greater than or equal to a reference number or a reference width.

19. A method of performing a sensing operation in an organic light emitting diode (OLED) display device comprising a plurality of pixels, the method comprising:

applying a test voltage pattern to pixels in one line among the plurality of pixels;

receiving an output voltage pattern generated in response to the test voltage pattern from the pixels in the one line;

determining whether a sensing error occurs by comparing the output voltage pattern with the test voltage pattern;

when the sensing error is determined not to occur, applying a sensing voltage to the plurality of pixels;

receiving a plurality of output voltages generated in response to the sensing voltage from the plurality of pixels;

generating frame-sensing data by performing analog-to-digital conversion on the plurality of output voltages;

detecting an abnormal sensing-data line from among the frame-sensing data; and replacing the abnormal sensing-data line by a data line generated based on at least one sensing-data line that is adjacent to the abnormal sensing-data line in the frame-sensing data.

20. An organic light emitting diode (OLED) display device comprising:

a display panel comprising a plurality of pixels;

a data driver configured to apply a test voltage pattern to pixels in one line among the plurality of pixels when a one-line sensing operation is performed, and to apply a sensing voltage to the plurality of pixels when a frame-sensing operation is performed;

a sensing circuit configured to generate one-line sensing data corresponding to an output voltage pattern generated in response to the test voltage pattern when the one-line sensing operation is performed, and to generate frame-sensing data corresponding to a plurality of output voltages generated in response to the sensing voltage when the frame-sensing operation is performed; and a controller configured to determine whether a sensing error occurs by comparing the output voltage pattern represented by the one-line sensing data with the test voltage pattern, to detect an abnormal sensing-data line from among the frame-sensing data, and to replace the abnormal sensing-data line by a data line generated based on at least one sensing-data line that is adjacent to the abnormal sensing-data line in the frame-sensing data.

* * * * *